United States Patent [19]

Harandi et al.

[11] Patent Number: 4,936,976

[45] Date of Patent: Jun. 26, 1990

[54] INTEGRATED REFORMING/AROMATIZATION PROCESS

[75] Inventors: Mohsen N. Harandi, Lawrenceville; Hartley Owen, Belle Mead, both of N.J.

[73] Assignee: Mobil Oil Corp., New York, N.Y.

[21] Appl. No.: 318,225

[22] Filed: Mar. 2, 1989

[51] Int. Cl.[5] ..... C10G 35/04

[52] U.S. Cl. ..... 208/66; 585/407; 585/412; 585/413

[58] Field of Search ..... 208/66; 585/407, 412, 585/413

[56] References Cited

U.S. PATENT DOCUMENTS

| | | | |
|---|---|---|---|
| 3,890,218 | 6/1975 | Morrison | 208/135 |
| 3,928,174 | 12/1975 | Bonacci et al. | 208/80 |
| 4,347,395 | 8/1982 | Chu et al. | 585/420 |
| 4,579,987 | 4/1986 | Chang et al. | 585/415 |
| 4,590,321 | 5/1986 | Chu | 585/415 |
| 4,607,130 | 8/1986 | Chang et al. | 585/415 |
| 4,629,818 | 12/1986 | Burress | 585/517 |

OTHER PUBLICATIONS

"M2 Forming–A Process for Aromatization of Light Hydrocarbons", Chen et al, 25 Ind. Eng. Chem. Process Des. Dev., 151 (1986).

*Primary Examiner*—Curtis R. Davis

*Attorney, Agent, or Firm*—Alexander J. McKillop; Charles J. Speciale; Robert B. Furr, Jr.

[57] ABSTRACT

An integrated reforming/aromatization process is disclosed which improves the octane number and $C_5+$ liquid yield of a catalytic reforming unit by integrating a catalytic aromatization zone into a catalytic reforming unit gas plant fractionator overhead condenser reflux circuit. The fractionator may be operated as a debutanizer to maximize $C_{5+}$ gasoline product volume or a depentanizer to maximize $C_{5+}$ gasoline product octane number.

13 Claims, 1 Drawing Sheet

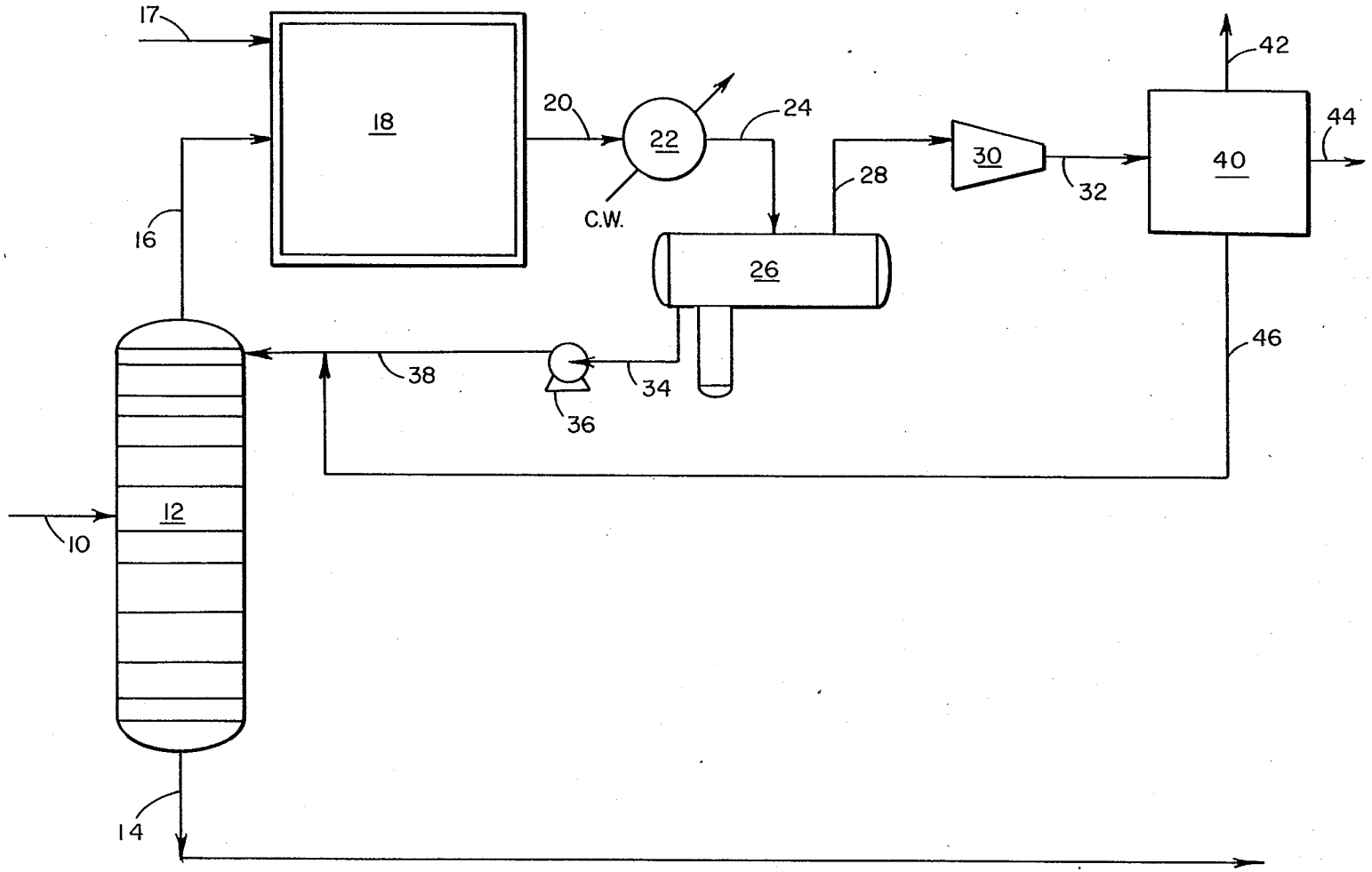
44
42
40
46
32
30
28
24
26
22
C.W.
34
36
20
18
38
17
16
12
14
10

INTEGRATED REFORMING/AROMATIZATION PROCESS

FIELD OF THE INVENTION

This invention relates to a method for increasing the yield of valuable $C_5+$ gasoline in a catalytic reforming process unit. In particular, the invention relates to integrating an aromatization reaction zone into the catalytic reforming unit debutanizer reflux circuit.

BACKGROUND OF THE INVENTION

Catalytic reforming is one of the most widely used refining processes, upgrading a low-octane naphtha boiling range fraction to a high octane gasoline blending stock. The reforming reactions are carried out in the presence of hydrogen and include isomerization, dehydrocyclization, dehydrogenation and hydrocracking. In particular, alkanes are both isomerized to iso-alkanes and dehydrocyclized to naphthenes. These newly formed naphthenes together with those existing in the feedstream are then dehydrogenated to aromatics. To summarize, reforming reshapes a low-octane naphtha feed into a product stream which more closely resembles a high-octane mixture of iso-octane and toluene.

Gasoline yield, octane increase and reaction severity are interrelated in the reforming process. Higher reaction temperatures and lower space velocities provide a greater octane upgrade but carry the penalty of increased light gas and coke production. In addition to decreasing the relative gasoline yield, additional coke make accelerates catalyst deactivation. Further, the incremental product shift from liquid to gas loads the reformer gas plant and decreases the economic value of the overall product slate.

For example, U.S. Pat. No. 3,890,218 to Morrison teaches a reforming process using a crystalline zeolite catalyst having the structure of ZSM-5. The Morrison patent shows a plot of $C_5+$ volume percent recovery as a function of research clear octane number for a given feed and process conditions. This limitation inherent to catalytic reforming is clearly incompatible with the present and future product demands.

Recent changes in internal combustion engine design to enhance fuel efficiency and performance while decreasing pollutant emissions have increased demand for high octane gasoline. Demand is growing not only for a greater volume of premium gasoline but also for premium gasolines having higher octane numbers. Further, stricter environmental regulations preclude the use of many highly efficacious octane enhancing additives such as tetraethyl lead. Refiners must now meet the market demand for higher octane gasoline in relatively greater volumes without the use of prohibited octane enhancing additives. At the same time, refiners must meet the need for additional hydrogen to supply new hydroprocessing units, examples of which include catalytic dewaxing and lube hydrotreating units.

By way of background, catalytic reforming process units are typically associated with a produce recovery section, or gas plant. The gas plant includes a plurality of fractionation towers and may also include one or more gas/liquid absorption towers. An example of a typical gas plant scheme includes a debutanizer, depropanizer and deethanizer/absorber.

Reformer reactor effluent typically flows first to feed/effluent preheat exchangers and then to air or water cooled reactor effluent coolers. The cooled reactor effluent is flashed in a high pressure separator vessel to split off hydrogen-rich recycle gas from the reactor effluent product which is, at this point, called unstabilized reformate.

Unstabilized reformate is then charged to the debutanizer fractionator which separates the $C_4-$ fraction as overhead product from $C_5+$ normally liquid gasoline product. The $C_4-$ debutanizer fractionator overhead product is then charged to a depropanizer which fractionates the debutanizer overhead into a butane-rich bottom stream and a $C_3-$ overhead stream. Finally, the $C_3-$ stream is cut into a propane-rich bottom stream and an overhead light gas stream which is usually burned as fuel gas.

Catalytic processes have also been developed to convert light $C_2$–$C_4$ hydrocarbons to more valuable $C_5+$ compounds, particularly $C_6+$ aromatics. These processes are commonly referred to as M-2 Forming and are described in the article, "M2 Forming-A Process for Aromatization of Light Hydrocarbons" by N.Y. Chen and T.Y. Yan, 25 IND. ENG. CHEM. PROCESS DES. DEV., 151 (1986), the teachings of which are incorporated herein by reference for a general overview of such catalytic upgrading processes.

Commercial reforming units with their widely recognized record of reliable operation have become cornerstones of modern gasoline refining facilities. These reformer units would benefit from an improvement which combines their relatively high throughput with enhanced liquid product yield and octane number.

U.S. Pat. No. 3,928,174 to Bonacci et al. teaches a process for improving the overall product slate from a catalytic reforming process by catalytically upgrading $C_2-$ light gas to a mixture of $C_3$–$C_4$ aliphatics commonly referred to as LPG. Thus, the reforming process may be operated to maximize production of $C_5+$ aromatic gasoline and the resulting $C_2-$ light gas, rather than being burned as fuel gas, is converted into saleable LPG product.

Further developments in the art of light hydrocarbon upgrading, specifically aromatization of light hydrocarbons, are exemplified by U.S. Pat. No. 4,347,395 to Chu et al. which discloses a process for the conversion of $C_2$–$C_{16}$ paraffinic hydrocarbons to aromatics in the presence of oxygen and a zeolite catalyst. Still further advances in M-2 Forming are taught in U.S. Pat. Nos. 4,579,987 to Chang et al; 4,590,321 to Chu; 4,607,130 to Chang et al; and 4,629,818 to Burress.

SUMMARY OF THE INVENTION

The present invention increases the $C_5+$ gasoline yield from a catalytic reforming unit by integrating an aromatization reaction zone into the catalytic reforming unit gas plant debutanizer overhead condenser circuit. By aromatizing the debutanizer overhead stream, the yield distribution of the integrated reformer unit is shifted away from less valuable $C_4-$ light products and toward more marketable $C_5+$ gasoline while producing much-needed hydrogen for use in hydroprocessing units. Moreover, an existing catalytic reforming unit may easily be retrofitted to operate the improved process of the present invention.

The process of the present invention integrates an aromatization reaction zone into the overhead reflux circuit of the debutanizer of a catalytic reformer unit gas plant. In addition to energy and capital cost savings normally associated with integrated process units, the process of the present invention provides markedly increased operating flexibility and $C_5+$ gasoline yield.

The Morrison '218 patent cited above notes the inverse relationship between liquid yield and octane improvement in a catalytic reforming process. The integrated process of the present invention converts light $C_4-$ aliphatics from the catalytic reformer product stream to more valuable $C_5+$ gasoline. Thus, the catalytic reformer may be operated at higher severity to maximize octane boost for the liquid reformer product while the additional $C_4-$ gas produced as a consequence of more severe reforming conditions is converted to valuable $C_5+$ liquid product in the catalytic aromatization zone. Conversely, if product demands and the available naphtha feed dictate less severe operating conditions for the catalytic reformer, the octane increase across the reformer reactors will be less than in the case of more severe operating conditions. To compensate, then, operation of the aromatization zone can be adjusted to favor selectivity toward high octane aromatics such as toluene. The present process thereby provides the refiner with much-needed flexibility to produce a relatively stable gasoline octane pool given varying quality naphtha feeds to the catalytic reforming process. This same flexibility enables the refiner to adjust gasoline pool volume and octane to meet seasonal variations in demand.

The integrated process of the present invention converts the overhead stream from the first fractionator tower of a catalytic reforming unit gas plant to an aromatics-rich gasoline stream. The first reformer gas plant fractionator tower is typically a debutanizer which removes $C_4-$ material from the unstabilized reformate. However, the debutanizer fractionator may alternatively be operated as a depentanizer, shifting the fractionation point from $C_4/C_5$ to $C_5/C_6$. When the first reformer gas plant fractionator is operated as a depentanizer, the aromatization zone feedstream comprises $C_5$ hydrocarbons as well as the $C_4-$ cut. Shifting the cut point of a fractionator tower as described is readily accomplished by one of ordinary skill in the art with a moderate amount of trial and error. The following description refers to operation of the present inventive process in terms of its use with a debutanizer fractionator. It is to be understood that a depentanizer fractionator may also be used and that the accompanying adjustments to optimize the operation of the aromatization zone to convert $C_5-$ feed rather than $C_4-$ feed are within the knowledge of one of ordinary skill in the art, given reasonable trial and error. The depentanizer fractionator operating mode is favored for maximizing octane number in the final gasoline product.

Previous process schemes have upgraded $C_3-C_4$ reformer gas plant streams by conversion reactions including isomerization, alkylation, oligomerization and aromatization. However, the benefits of integrating a catalytic aromatization zone into the overhead reflux circuit of a catalytic reformer debutanizer (or depentanizer) have not previously been recognized.

The invention comprises a process for increasing the $C_5+$ yield of a catalytic reforming process which includes the steps of charging a naphtha boiling range feedstream to a catalytic reforming reaction zone under reforming conversion conditions, withdrawing a product stream from the reforming reaction zone, separating the product stream in a fractionation zone into an overhead stream containing $C_4-$ components and a bottom stream containing $C_{6+}$ components charging the fractionator overhead stream to a catalytic aromatization zone under aromatization conversion conditions, withdrawing aromatized product from the catalytic aromatization zone, cooling the aromatized product, separating the aromatized product into a $C_4-$ stream and a $C_5+$ stream and refluxing the gasoline stream to the fractionation zone.

DESCRIPTION OF THE DRAWING

The FIGURE is a simplified schematic diagram illustrating the process of the present invention.

DETAILED DESCRIPTION

The present process increases the yield of $C_5+$ gasoline and hydrogen from a catalytic reforming unit by aromatizing a catalytic reforming debutanizer fractionator overhead stream and refluxing the aromatized $C_5+$ gasoline to an upper tray of the debutanizer fractionator.

Reforming Process

Reforming upgrades a relatively low-octane naphtha boiling range fraction which is typically rich in paraffins and naphthenes. Reformer feedstreams typically range in research octane number from about 60 to about 80.

The reforming process is carried out typically at temperatures in the range of about 316°-575° C. (600°-1070° F.), preferably about 454°-532° C. (850°-990° F.), more preferably 482°-527° C. (900°-980° F.). Operating pressures range from 30-1000 psig (308-6696 kPa), preferably 100-400 psig (791-2859 kPa), more preferably 100-350 psig (791-2514 kPa). Typically, liquid hourly space velocities range from 0.1-10 $hr^{-1}$, preferably 1-5 $hr^{-1}$.

Suitable catalysts include metals on inert supports, examples of which metals include platinum, iridium, rhenium and tin. Reforming catalysts are discussed in the references cited below, as well as in H. Pines, *The Chemistry of Catalytic Hydrocarbon Conversions*, 102-110 (1981). Zeolite catalysts may also be used to promote the reforming reactions. Such catalysts are described below.

The reforming process may be carried out in a variety of reaction zone configurations with fixed- and moving-bed units finding the widest commercial use. Moving-bed units are typically operated in conjunction with a continuous catalyst regeneration unit. Fixed-bed designs, on the other hand, are typically regenerated in-situ. In the so-called swing reactor design, the reforming unit includes at least one more reactor than is required for normal operation. Each reactor is piped and valved such that one reactor may be taken out of service for regeneration while the other reactors operate on stream. In the conventional fixed-bed design, the entire reforming unit is typically taken out of service for in-situ catalyst regeneration. The present invention yields its highly beneficial results when used with any of these reformer configurations.

Examples of reforming processes are taught in U.S. Pat. Nos. 3,890,218 to Morrison; 3,914,171 to Schoennagel; 4,010,093 to Maziuk; 4,292,167 to Bonacci et al.; 4,401,554 to Choi et al.; and 4,551,228 to Ramella et al. The disclosures of these patents are incorporated by reference as if set forth at length herein for details of the operation of catalytic reforming process units.

Aromatization Process

Hydrocarbon upgrading reactions compatible with the process of the present invention include the conversion of aliphatic hydrocarbons to aromatic hydrocarbons. The article "M2 Forming-A Process for Aromatization of Light Hydrocarbons" by N. Y. Chen and T. Y. Yan, *Ind. Eng. Chem. Process Des. Dev.* 25, 151-155 (1986), surveys developments in the area of light aliphatics aromatization and discloses a theoretical mechanism for the reactions. The text of the Chen et al. article is incorporated by reference as if set forth at length herein. The following representative U.S. patents detail the feed compositions and process conditions for these reactions. Aromatization process conditions are summarized in Table 1.

U.S. Pat. No. 3,756,942, incorporated by reference as if set forth at length herein, discloses a process for the preparation of aromatic compounds in high yields which involves contacting a particular feed consisting essentially of mixtures of paraffins and/or olefins, and/or naphthenes with a crystalline aluminosilicate, e.g. ZSM-5, under conditions of temperature and space velocity such that a significant portion of the feed is converted directly into aromatic compounds.

U.S. Pat. No. 3,760,024, incorporated by reference as if set forth at length herein, teaches a process for the preparation of aromatic compounds involving contacting a feed consisting essentially of $C_2$-$C_4$ paraffins and/or olefins with a crystalline aluminosilicate, e.g. ZSM-5.

Details of the operation of a fluid-bed aromatization reactor are taught in U.S. Pat. No. 4,751,338 to Tabak et al., incorporated by reference as if set forth at length herein.

The reaction severity conditions can be controlled to optimize yield of $C_6$-$C_8$ BTX (benzene, toluene and xylene) hydrocarbons. It is understood that aromatics and light olefin production is promoted by those zeolite catalysts having a high concentration of Bronsted acid reaction sites. Accordingly, an important criterion is selecting and maintaining catalyst inventory to provide either fresh or regenerated catalyst having the desired properties. Typically, acid cracking activity (alpha value) can be maintained from high activity values greater than 40 to significantly lower values under steady state operation by controlling fresh catalyst makeup as well as catalyst deactivation and regeneration rates to provide an apparent average alpha value (based on total catalyst inventory) below 40, preferably about 2 to 20.

When Alpha Value is examined, it is noted that the Alpha Value is an approximate indication of the catalytic cracking activity of the catalyst compared to a standard catalyst and it gives the relative rate constant (rate of normal hexane conversion per volume of catalyst per unit time). It is based on the activity of the highly active silica-alumina cracking catalyst taken as an Alpha of 1 (Rate Constant$=0.016^{-1}$). The Alpha Test is described in U.S. Pat. No. 3,354,078; in the *Journal of Catalysis*, Vol 4, p. 527 (1965); Vol. 6, p. 278 (1966); and Vol. 61, p. 393 (1980), each incorporated herein by reference as to that description. The experimental conditions of the test used herein include a constant temperature of 538° C. and a variable flow rate as described in detail in the *Journal of Catalysis*, Vol. 61, p. 395.

TABLE 1

| Gasoline Upgrading Reaction Process Conditions | |
|---|---|
| WHSV | Broad range: 0.3-300 $hr^{-1}$ |
| | Preferred range: 1-10 $hr^{-1}$ |
| Operating Pressure | Broad: 170-2170 kPa (10-300 psig) |
| | Preferred: 650-1350 kpa (80-180 psig) |
| Operating Temperature | Broad: 500-820° C. (930-1500° F.) |
| | Preferred: 560-620° C. (1050-1150° F.) |

Zeolite Catalysts

The members of the class of zeolites useful in the process of the present invention have an effective pore size of generally from about 5 to about 8 Angstroms, such as to freely sorb normal hexane. In addition, the structure must provide constrained access to larger molecules. It is sometimes possible to judge from a known crystal structure whether such constrained access exists. For example, if the only pore windows in a crystal are formed by 8-membered rings of silicon and aluminum atoms, then access by molecules of larger cross section than normal hexane is excluded and the zeolite is not of the desired type. Windows of 10-membered rings are preferred, although, in some instances, excessive puckering of the rings or pore blockage may render these zeolites ineffective.

Although 12-membered rings in theory would not offer sufficient constraint to produce advantageous conversions, it is noted that the puckered 12-ring structure of TMA offretite does show some constrained access. Other 12-ring structures may exist which may be operative for other reasons, and therefore, it is not the present intention to entirely judge the usefulness of the particular zeolite solely from theoretical structural considerations.

A convenient measure of the extent to which a zeolite provides control to molecules of varying sizes to its internal structure is the Constraint Index of the zeolite. The method by which the Constraint Index is determined is described in U.S. Pat. No. 4,016,218, incorporated herein by reference for details of the method. U.S. Pat. No. 4,696,732 discloses Constraint Index values for typical zeolite materials and is incorporated by reference as is set forth at length herein.

In a preferred embodiment, the catalyst is a zeolite having a Constraint Index of between about 1 and about 12. Examples of such zeolite catalysts include ZSM-5, ZSM-11, ZSM-12, ZSM-22, ZSM-23, ZSM-35 and ZSM-48.

Zeolite ZSM-5 and the conventional preparation thereof are described in U.S. Pat. No. 3,702,886, the disclosure of which is incorporated herein by reference. Other preparations for ZSM-5 are described in U.S. Pat. Nos. Re. 29,948 (highly siliceous ZSM-5); 4,100,262 and 4,139,600, the disclosure of these is incorporated herein by reference. Zeolite ZSM-11 and the conventional preparation thereof are described in U.S. Pat. No. 3,709,979, the disclosure of which is incorporated herein by reference. Zeolite ZSM-12 and the conventional preparation thereof are described in U.S. Pat. No. 3,832,449, the disclosure of which is incorporated herein by reference. Zeolite ZSM-23 and the conventional preparation thereof are described in U.S. Pat. No. 4,076,842, the disclosure of which is incorporated herein by reference. Zeolite ZSM-35 and the conventional preparation thereof are described in U.S. Pat. No. 4,016,245, the disclosure of which is incorporated herein by reference. Another preparation of ZSM-35 is described in U.S. Pat. No. 4,107,195, the disclosure of which is incorporated herein by reference. ZSM-48 and the conventional preparation thereof is taught by U.S. Pat. No. 4,375,573, the disclosure of which is incorporated herein by reference.

Gallium-containing zeolite catalysts are particularly preferred for use in the present invention and are disclosed in U.S. Pat. No. 4,350,835 and U.S. Pat. No. 4,686,312, both of which are incorporated by reference as if set forth in length herein.

Zinc-containing zeolite catalysts are also preferred for use in the present invention, for example, U.S. Pat. No. 4,392,989 and U.S. Pat. No. 4,472,535, both of which are incorporated by reference as if set forth at length herein.

Catalysts such as ZSM-5 combined with a Group VIII metal described in U.S. Pat. No. 3,856,872, incorporated by reference as if set forth at length herein, are also useful in the present invention.

Process Flow

Referring now to the FIGURE, liquid reformer product flows through line 10 to debutanizer fractionator 12 where it is fractionated into a $C_5+$ bottoms product which flows out of debutanizer fractionator 12 through line 14 and is sent to gasoline blending or product storage, and a $C_4-$ overhead product which is removed from debutanizer fractionator 12 through line 16 and charged to aromatization unit 18. The aromatization unit includes heating means and reactor means. The reactor means may comprise a fixed, moving or fluidized bed reactor, preferably a fluidized bed reactor. The operation of a fluid bed catalytic aromatization process is taught in U.S. Pat. No. 4,746,762 to Avidan et al, the text of which is incorporated herein by reference. The heating means may include, for example, a heat exchanger positioned inside the reaction zone or a process furnace to preheat feed before it is charged to the aromatization reactor, or both a preheat furnace and a reactor heat exchanger.

The overhead stream from debutanizer fractionator 12 is typically rich in paraffins. Paraffin aromatization tends to be strongly endothermic. If it is desired to reduce the heat input required to the aromatization reactor, an olefinic stream may be co-fed to the aromatization reactor via line 17. Olefins aromatize exothermically, thus supplying at least a portion of the endothermic heat of reaction for paraffin aromatization. U.S. Pat. No. 3,845,150 to Yan and Zahner teaches such a heat-balanced upgrading process and is incorporated by reference as if set forth at length herein. Suitable olefinic streams include olefinic $C_5-$ streams from the product recovery section of a fluid catalytic cracking unit, particularly an olefinic $C_3$–$C_4$ stream.

Aromatized product is withdrawn from the aromatization unit 18 through line 20 and charged to overhead cooler 22 which reduces the product temperature to a level such that the product may be separated in a downstream accumulator into a $C_4-$ vapor stream and a $C_5+$ liquid stream. This temperature is typically about 38° C. (100° F.). While overhead cooler 22 is shown as a cooling water exchanger, it may also consist of a feed-effluent exchanger, an air-cooled exchanger or a combination of two or more of such exchangers.

The cooled product stream is withdrawn from overhead condenser 22 through line 24 and is charged to overhead accumulator 26 where it is flashed to separate $C_5+$ liquid gasoline from $C_4-$ gas. The $C_5+$ liquid gasoline is withdrawn from overhead accumulator 26 through line 34 and refluxed to a debutanizer fractionator 12 through pump 36 and line 38, preferably to an upper tray of debutanizer fractionator 12.

The vapor stream containing $C_4-$ aliphatic hydrocarbons is withdrawn from overhead accumulator 26 through line 28 and charged to compressor 30. The compressed vapor stream, which may be at least partially liquified, flows through line 32 to separation section 40 which may comprise at least one fractionation tower. The separation section 40 fractionates the compressed overhead stream from overhead accumulator 26 into a hydrogen-rich stream, a fuel gas stream and a $C_3+$ recycle stream. The hydrogen-rich stream is withdrawn from separation section 40 through line 42 and may be circulated back to the reformer reactor feed or to other process units requiring a hydrogen-rich stream, for example a catalytic hydrodesulfurization unit, a lube hydrotreater or a catalytic hydrodewaxing unit. Fuel gas flows through line 44 to a fuel gas header where it is typically routed to fired process furnaces. The $C_3+$ stream flows through line 46, joins the reflux stream flowing through line 38 and is refluxed to debutanizer fractionator 12 as described above.

Computer Simulated Example

The following data illustrating the beneficial results of the integrated process of the present invention were obtained from a computer-based chemical process model program. The product slates shown below compare a typical catalytic reforming process with the integrated reforming process of the present invention. Yields shown are based on a desulfurized naphtha feed. Yields shown are weight percent of naphtha feed.

| Component | Catalytic Reforming | Integrated Reforming |
|---|---|---|
| $H_2$ | 3.0 | 3.8 |
| $C_1$–$C_2$ | 3.3 | 7.2 |
| $C_3$–$C_4$ | 10.6 | 2.6 |
| $C_5$ | 6.8 | 2.0 |
| $C_6+$ | 76.3 | 84.4 |
| $C_5+$ motor octane | 90.0 | 93.5 |

Changes and modifications in the specifically described embodiments can be carried out without departing from the scope of the invention which is intended to be limited only by the scope of the appended claims.

What is claimed is:

1. An integrated process for increasing the gasoline yield from a catalytic reforming process comprising the steps of:

(a) charging a naphtha boiling range feedstream to a catalytic reforming reaction zone under reforming conversion conditions;

(b) withdrawing a reactor effluent stream from said reforming reaction zone;

(c) separating said reactor effluent stream into a hydrogen-rich gas stream and an unstabilized reformate stream;

(d) further separating said unstabilized reformate in a fractionator into an overhead stream containing $C_4-$ components and a bottom stream containing $C_6+$ components;

(e) charging said fractionator overhead stream of step (d), above, to a catalytic aromatization zone under aromatization conversion conditions;

(f) withdrawing an aromatization zone effluent stream from said aromatization zone;

(g) cooling said aromatization zone effluent stream;

(h) separating said cooled aromatization zone effluent stream into a $C_4-$ stream and a $C_5+$ stream; and (i) refluxing said $C_5+$ aromatic gasoline stream to said fractionation zone.

2. The process of claim 1 wherein said overhead stream from said fractionator of step (d), above, further comprises $C_5$ components.

3. The process of claim 1 wherein said catalytic reforming reaction zone contains a catalyst comprising platinum on an inert support.

4. The process of claim 1 wherein said catalytic reforming reaction zone contains a catalyst comprising at least one selected from the group consisting of platinum, rhenium, iridum and tin.

5. The process of claim 1 wherein said reforming conversion conditions comprise temperatures between about 316° and 538° C. (600° and 1000° F.), pressures between about 446 and 6696 kPa (50 and 1000 psig) and liquid hourly space velocities between 0.1 and 10 $hr^{-1}$.

6. The process of claim 1 wherein said reforming conversion conditions comprise temperatures between about 482° and 527° C. (900° and 980° F.), pressures between about 791 and 2541 kPa (100 and 350 psig) and liquid hourly space velocities between 1 and 5 $hr^{-1}$.

7. The process of claim 1 wherein said aromatization conversion conditions comprise temperatures between about 540° and 820° C. (1000° and 1500° F.), pressures between about 170 and 2170 kPa (10 and 300 psig) and weight hourly space velocities between 0.3 and 300 $hr^{-1}$.

8. The process of claim 1 wherein said aromatization conversion conditions comprise temperatures between about 560° and 620° C. (1050° and 1150° F.), pressures between about 310 and 790 kPa (30 and 100 psig) and weight hourly space velocities between 1 and 10 $hr^{-1}$.

9. The process of claim 1 wherein said aromatization zone contains a catalyst comprising a zeolite.

10. The process of claim 9 wherein said zeolite has a Constraint Index of between about 1 and about 12.

11. The process of claim 10 wherein said zeolite has the structure of at least one selected from the group consisting of ZSM-5, ZSM-11, ZSM-12, ZSM-22, ZSM-23, ZSM-35 and ZSM-48.

12. The process of claim 10 wherein said catalyst has the structure of ZSM-5.

13. The process of claim 12 wherein said zeolite contains gallium.

* * * * *